US010745895B2

(12) United States Patent
Li

(10) Patent No.: US 10,745,895 B2
(45) Date of Patent: Aug. 18, 2020

(54) AUTO-RETRACTING MECHANISM FOR FAUCET SPRAY HEAD

(71) Applicant: AS America, Inc., Piscataway, NJ (US)

(72) Inventor: Hsiao Chang Li, Edison, NJ (US)

(73) Assignee: AS America, Inc., Piscataway, NJ (US)

( * ) Notice: Subject to any disclaimer, the term of this patent is extended or adjusted under 35 U.S.C. 154(b) by 580 days.

(21) Appl. No.: 14/859,796

(22) Filed: Sep. 21, 2015

(65) Prior Publication Data

US 2016/0083942 A1 Mar. 24, 2016

Related U.S. Application Data

(60) Provisional application No. 62/054,141, filed on Sep. 23, 2014.

(51) Int. Cl.
*E03C 1/04* (2006.01)

(52) U.S. Cl.
CPC ..... *E03C 1/0404* (2013.01); *E03C 1/04* (2013.01); *E03C 2001/0415* (2013.01)

(58) Field of Classification Search
CPC ..... E03C 1/0404; E03C 2001/0415; E03C 2001/0417
USPC ..... 4/678; 137/355.2
See application file for complete search history.

(56) References Cited

U.S. PATENT DOCUMENTS

| | | | | |
|---|---|---|---|---|
| 5,934,325 | A * | 8/1999 | Brattoli | E03C 1/0404 137/801 |
| 6,085,790 | A | 7/2000 | Humpert et al. | |
| 6,738,996 | B1 | 5/2004 | Malek et al. | |
| 6,915,816 | B2 | 7/2005 | Nelson et al. | |
| 7,162,782 | B1 | 1/2007 | Nelson | |
| 7,699,241 | B2 | 4/2010 | Benstead | |
| 7,748,406 | B2 | 7/2010 | Pilatowicz et al. | |
| 8,152,078 | B2 | 4/2012 | Jianglin et al. | |
| 8,376,248 | B2 | 2/2013 | Meisner et al. | |
| 8,413,686 | B2 | 4/2013 | Ko | |
| 8,727,241 | B2 | 5/2014 | Bosio | |
| 8,776,836 | B2 | 7/2014 | Ragner et al. | |
| 8,800,075 | B2 | 8/2014 | van Leyen et al. | |
| 2002/0117853 | A1* | 8/2002 | Bartholomew | F16L 37/098 285/305 |
| 2004/0010848 | A1 | 1/2004 | Esche | |

(Continued)

FOREIGN PATENT DOCUMENTS

| | | |
|---|---|---|
| CN | 203096843 | 7/2013 |
| EP | 1 178 255 | 2/2002 |

(Continued)

OTHER PUBLICATIONS

International Search Report Application No. PCT/2015/051169, International Filing Date Sep. 21, 2015, dated Jan. 22, 2016.

(Continued)

*Primary Examiner* — David P Angwin
*Assistant Examiner* — William R Klotz
(74) *Attorney, Agent, or Firm* — Morrison & Foerster LLP

(57) ABSTRACT

An auto-retracting faucet spray head has an auto-retract mechanism, which includes a docking assembly provided at the end of the faucet body to facilitate automatic retraction and docking of the spray head. The docking assembly includes a spring-loaded mechanism that automatically docks the spray head to the faucet body when an adapter coupled to the spray head engages the docking assembly.

23 Claims, 7 Drawing Sheets

(56) References Cited

U.S. PATENT DOCUMENTS

| | | | | |
|---|---|---|---|---|
| 2004/0217196 | A1 | 11/2004 | Yurek, Jr. et al. | |
| 2007/0040380 | A1 | 2/2007 | Benstead | |
| 2008/0276367 | A1 | 11/2008 | Bares et al. | |
| 2009/0278347 | A1 | 11/2009 | Kerin et al. | |
| 2011/0006514 | A1* | 1/2011 | Li | B05B 15/065 285/148.2 |
| 2012/0042973 | A1 | 2/2012 | Ko | |
| 2012/0153050 | A1 | 6/2012 | Bosio | |
| 2012/0267455 | A1 | 10/2012 | Hansen | |
| 2013/0037626 | A1 | 2/2013 | Van Leyen et al. | |
| 2013/0180601 | A1 | 7/2013 | Li et al. | |
| 2014/0159362 | A1* | 6/2014 | Meehan | B05B 1/00 285/320 |
| 2016/0061369 | A1* | 3/2016 | Blessing | F16L 37/08 4/596 |

FOREIGN PATENT DOCUMENTS

| | | | |
|---|---|---|---|
| EP | 1 418 008 | | 5/2004 |
| EP | 2 674 534 | | 12/2013 |
| GB | 2461139 | A | 12/2009 |
| JP | S51-3407 | B | 2/1976 |
| JP | 9-310390 | | 12/1997 |
| JP | 2010-95947 | | 4/2010 |
| KR | 10-2005-0036956 | | 4/2005 |
| WO | 95/14187 | | 5/1995 |
| WO | WO-2005/098150 | | 4/2005 |

OTHER PUBLICATIONS

Extended European Search Report dated May 4, 2018, directed to EP Application No. 15843270.8; 9 pages.

Notice of Allowance dated Oct. 26, 2018, directed to KR Application No. 10-2017-7010464; 3 pages.

Notice of Preliminary Rejection dated Aug. 1, 2018, directed to KR Application No. 10-2017-7010464; 17 pages.

Office Action No. 8597 dated Jul. 16, 2018, directed to CO Application No. NC2017/0003744; 14 pages.

Notification of the First Office Action dated Feb. 2, 2019, directed to CN Application No. 201580051296.2; 16 pages.

* cited by examiner

AUTO-RETRACTING MECHANISM FOR FAUCET SPRAY HEAD

CROSS-REFERENCE TO RELATED APPLICATIONS

This application claims the benefit of U.S. Provisional Patent Application 62/054,141, entitled "AUTO-RETRACTING MECHANISM FOR FAUCET SPRAY HEAD," filed Sep. 23, 2014, the disclosure of which is incorporated by reference herein in its entirety.

FIELD OF THE INVENTION

The present invention generally relates to auto-retracting spray heads for faucets.

BACKGROUND OF THE INVENTION

Many commercially available faucets come equipped with pull-out spray heads that can help to ease the process of cleaning items placed under the tap. Typical faucets with pull-out spray heads use counterweights to assist in hose retraction. With such constructions, the spray heads may not fully retract to their docking positions due to hose friction and/or alignment issues between the spray heads and the spout tubes. Detents or magnets can be employed to assist in docking the spray heads to the faucet bodies; however, such mechanisms may not be optimal.

SUMMARY OF THE INVENTION

Generally speaking, it is an object of the present invention to provide an auto-retracting mechanism for a faucet spray head that avoids disadvantages of prior art constructions.

In accordance with an embodiment of the present invention, an auto-retracting faucet spray head includes an adapter coupled to the spray head that can be pulled away from a docking assembly of the faucet. When the adapter reaches an engagement zone of the docking assembly during refraction, the adapter enters into a gripping mechanism, and a captive spring can be activated to provide an assistive force to pull the gripping mechanism into the faucet. As the gripping mechanism is retracted into the faucet, it begins to radially close, grabbing the adapter and pulling it into engagement with the faucet.

It will be appreciated that the inventive auto-retracting mechanism can be provided as a module that can be easily installed in the faucet spout tube without requiring additional machining of the tube, and the adapter can be screwed into or otherwise secured to the spray head.

In some embodiments, a docking assembly configured to attach to a faucet body is provided. The docking assembly can include a shell and a gripping member slidably housed at least partially within the shell. The gripping member can include a gripper body and a gripper ring extending from the gripper body. The docking assembly may further include a turret fixed within the shell and concentrically arranged about at least a portion of the gripping member. The turret can include a first end having a chamfered interior wall for interacting with a docking assembly engagement member of a spray head adapter. The docking assembly can also include a captive spring arranged between the gripper ring and a second end of the turret. The captive spring can provide a motive force to slide the gripping member from an extended position to a docked position.

In some embodiments, the docking assembly can also include latching jaws pivotably arranged between the turret and the shell. The latching jaws can latch onto the gripper ring when the docking assembly is in the extended position and pivot to de-latch from the gripper ring when the docking assembly is moved from the extended position to the docked position. Each latching jaw can additionally include an adapter engagement member for receiving the docking assembly engagement member of the adapter between the adapter engagement member and the shell. Interaction between the docking assembly engagement member and the adapter engagement member pivots the latching jaws to disengage them from the gripper ring, which allows the captive spring to bear against the gripper ring, thereby moving the docking assembly into the docked position. In some embodiments, a compression ring may be retained within bores formed in the adapter engagement members to provide a radially outward directed force upon the adapter engagement members, which can serve to retain the docking assembly in the extended position until the docking assembly engagement member interacts with the adapter engagement member and overcomes the radially outwardly directed force provided by the compression ring.

In some embodiments, the turret can include a circumferential depression that serves as a pivot point for pivots of the latching jaws. A captive ring can be arranged concentrically between the pivots of the latching jaws and the shell to retain the latching jaws against the turret. The turret may also include a series of protrusions and spaces extending circumferentially about the turret on either side of the circumferential depression. The latching jaws can be arranged to lie in the spaces to prevent potential lateral or rotational movement.

In some embodiments, the gripping member can include flanged fingers that extend away from the gripper body and include a flange directed at least partially radially inward. When the flanged fingers are under no load, they may extend at least partially beyond an outer dimension of the gripper body. The flanged fingers can slide along the chamfered interior wall of the turret as the docking assembly is moved from the extended position to the docked position. As the gripping member slides, the chamfered interior wall provides an increasing load upon the flanged fingers thereby providing a radially inwardly directed force upon the flanged fingers.

In some embodiments, the shell can include a stepped portion configured to be retained within the faucet body. An apertured end of the stepped portion can be provided to slidably receive a portion of the gripping member and form a stop for the gripper ring to prevent movement of the gripping member past a defined point.

In some embodiments, an auto-retracting mechanism for a faucet spray head can be provided that includes a docking assembly according to various embodiments of the present invention and an adapter configured to couple to the faucet spray head. The adapter can include a body defining an internal conduit for conveying water from a hose to the faucet spray head, a docking assembly engagement member extending from and concentrically arranged about at least a portion of the body, and a latching rib extending radially away from the body. The docking assembly engagement member can be slidably received between the latching jaws and the shell. Interaction between the docking assembly engagement members and the latching jaws can cause the latching jaws to pivot in order to initiate the auto-retraction mechanism in which the latching jaws de-latch from the gripper ring and the captive spring bears against the gripper ring.

In some embodiments, the gripping member grips the latching rib as the auto-retracting mechanism is moved from the extended position to the docked position to pull the adapter into engagement with the docking assembly. A latching O-ring arranged in a circumferential depression adjacent to the latching rib may also be provided to increase the friction between the gripping member and the latching rib.

In some embodiments, the adapter body can include a hose coupling slidably receivable in the gripping member for coupling to a faucet hose and a spray head coupling member detachably coupleable to the faucet spray head.

Still other objects and advantages of the present invention will in part be obvious and will in part be apparent from the specification.

The present invention accordingly comprises the features of construction, combination of elements, and arrangement of parts all as exemplified in the constructions herein set forth, and the scope of the invention will be indicated in the claims.

BRIEF DESCRIPTION OF THE DRAWINGS

For a fuller understanding of the inventive embodiments, reference is had to the following description taken in connection with the accompanying drawings in which.

DETAILED DESCRIPTION OF THE PREFERRED EMBODIMENTS

Figure 1:
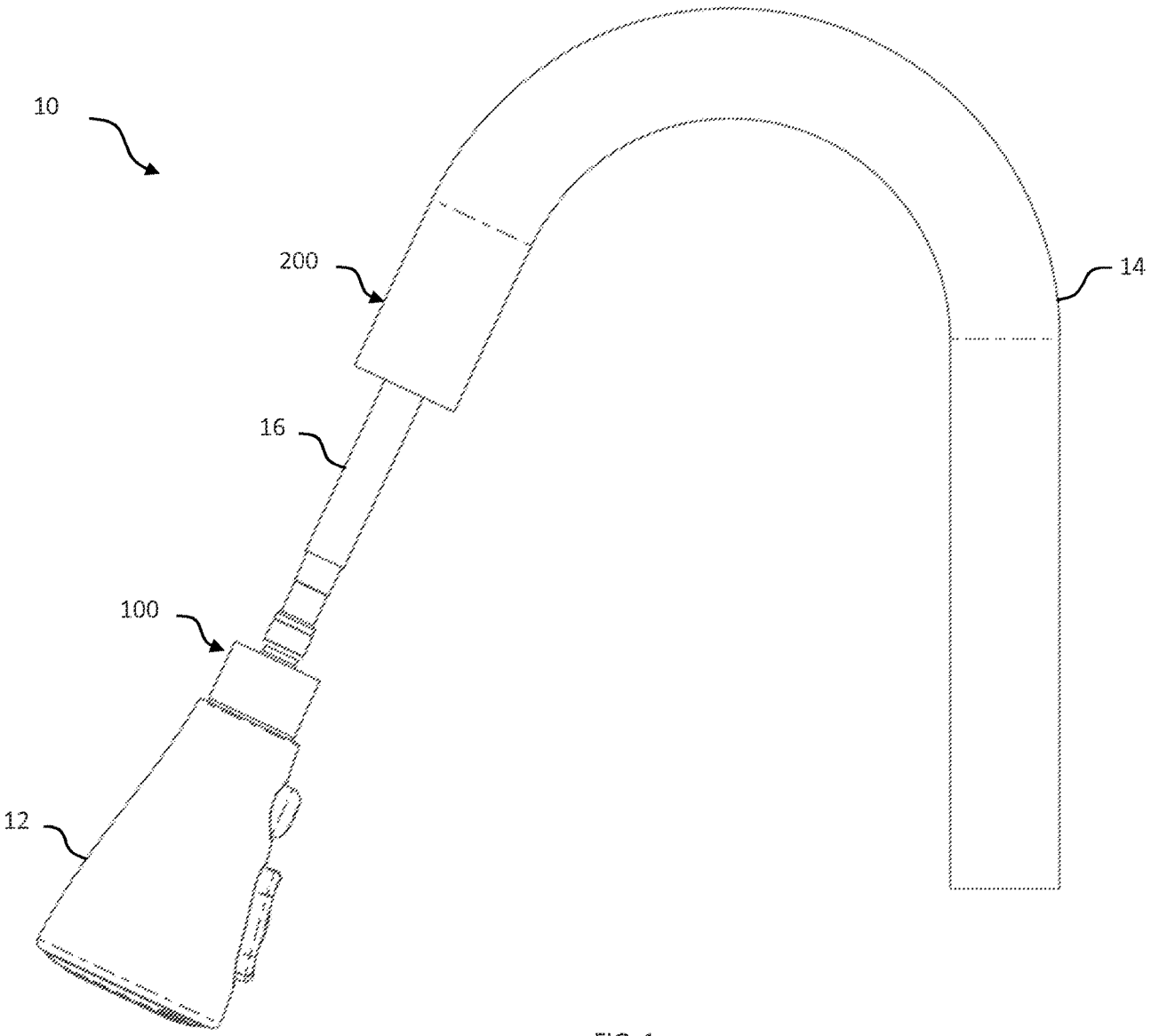
FIG. 1 shows a side view of a faucet having an auto-retracting spray head, in accordance with some embodiments of the present invention.

Referring now to the drawings, FIG. 1 shows a side view of faucet 10 having a faucet body 14, a hose 16, and an auto-retracting spray head 12 with an adapter 100, and docking assembly 200, in accordance with some embodiments of the present invention. Auto-retracting spray head 12, shown in an extended position, may be detachably coupled to faucet body 14 with docking assembly 200, which can assist in automatically docking adapter 100 (and thereby spray head 12) to faucet body 14 as described in detail hereinafter. During operation, water can flow through hose 16, an internal conduit of adapter 100, and out a tap of auto-retracting spray head 12 regardless of whether the spray head is in an extended position or a docked position relative to faucet body 14.

Figure 2:
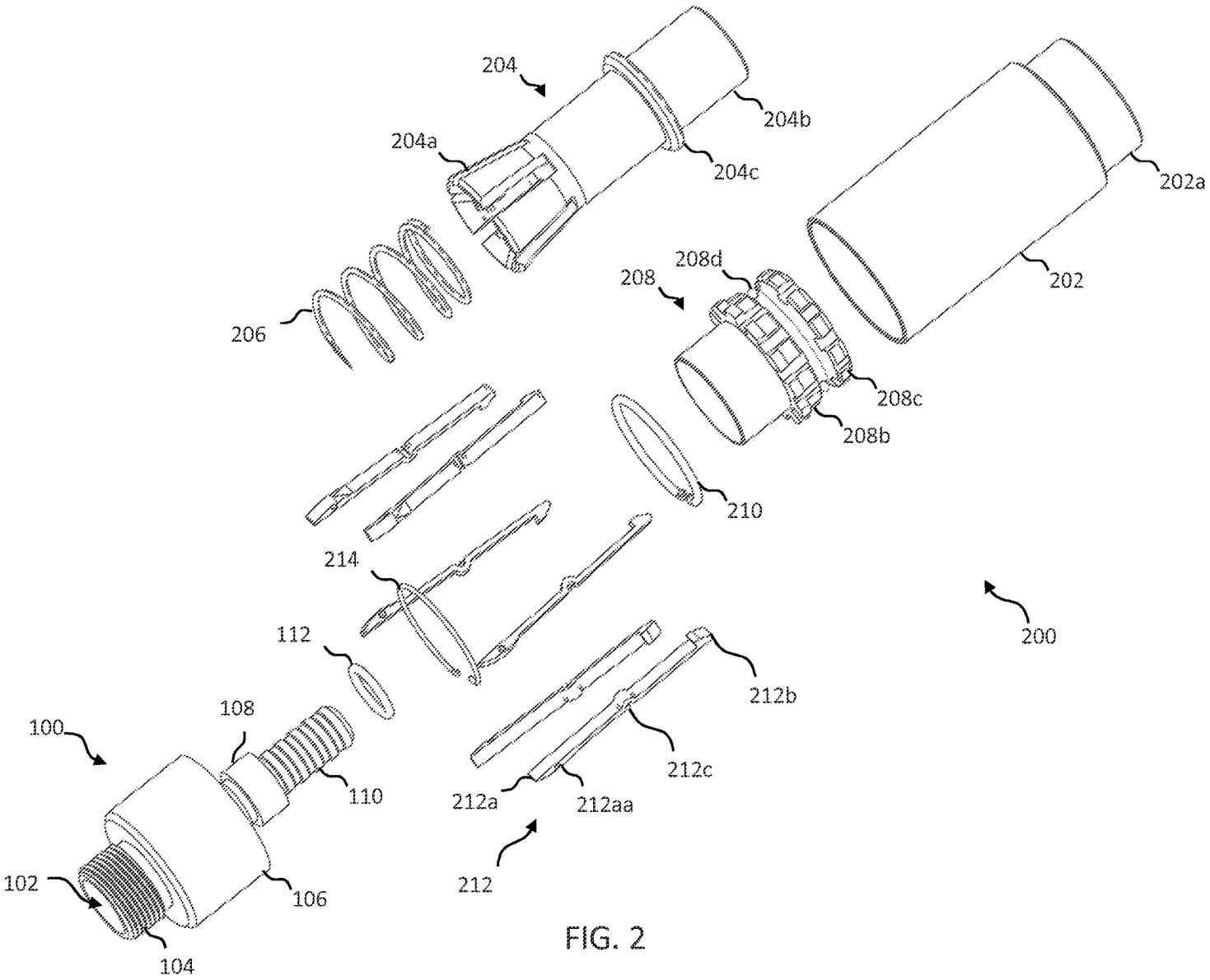
FIG. 2 shows an exploded view of the adapter and docking assembly of the auto-retracting mechanism of the auto-retracting spray head shown in FIG. 1, in accordance with some embodiments of the present invention.
Figure 3:
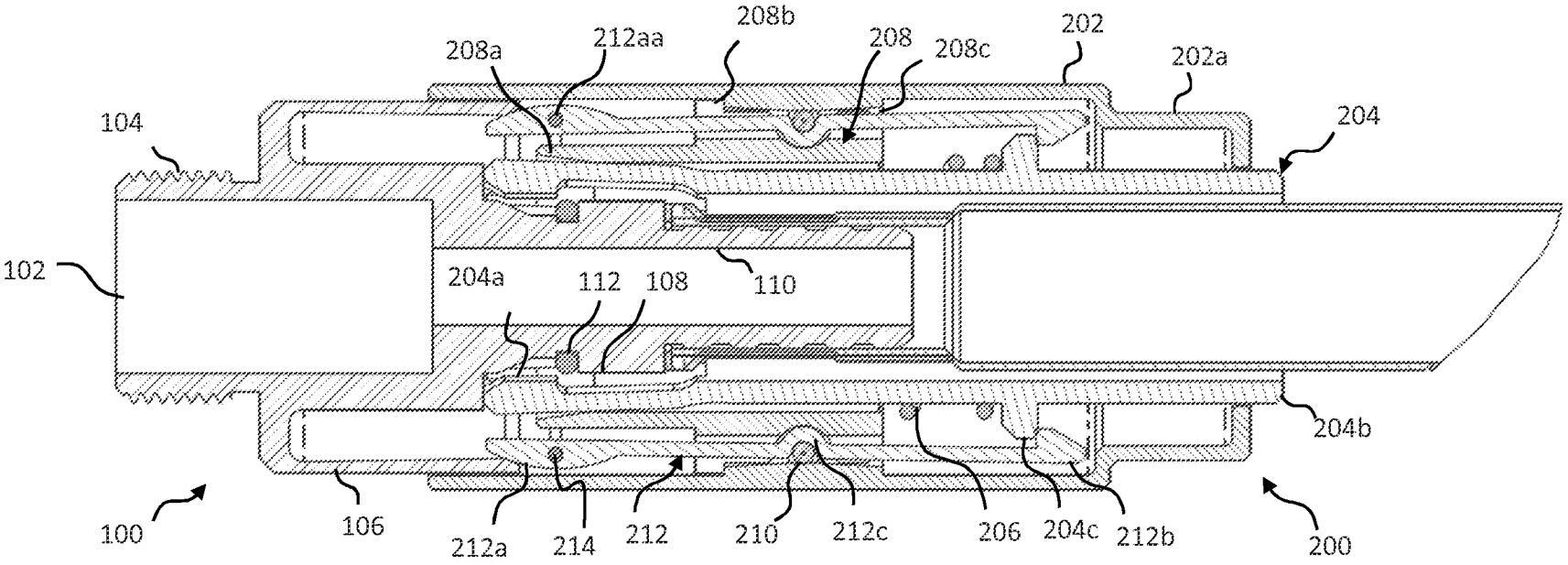
FIG. 3 shows a cross-sectional view of the adapter and docking assembly of FIG. 1, in accordance with some embodiments of the present invention.

FIG. 2 shows an exploded view and FIG. 3 shows a cross-sectional view of adapter 100 and docking assembly 200, in accordance with some embodiments of the present invention. Adapter 100 may include internal conduit 102 for conducting water from a hose (e.g. hose 16 of FIG. 1) to an auto-retracting spray head (e.g. auto-retracting spray head 12 of FIG. 1). In particular, the auto-retracting spray head may be coupled to spray head coupling 104, and the hose may be coupled to hose coupling 110. Each of these couplings may be fixed couplings (e.g. the spray head and/or hose may be integrally formed with adapter 100 or permanently affixed to adapter 100) or removable couplings (e.g. the spray head and/or hose may be coupled to adapter 100 using threaded couplings, one or more fasteners or clips, press fit couplings, or the like). As depicted in FIG. 2, the auto-retracting spray head can be coupled (e.g. threadably connected or coupled with one or more fasteners or clips) to spray head coupling 104, and the hose can be coupled to hose coupling 110 (e.g. frictionally engaged with the assistance of a hose clamp).

Adapter 100 may further include docking assembly engagement member 106 that may be configured to interact with docking assembly 200 to initiate an automatic docking process. Docking assembly engagement member 106 may be a hollow member with a closed end extending radially outward from a portion of adapter 100 proximate to spray head coupling 104 and with an open end proximate to hose coupling 110 and defining a cavity therebetween. As depicted in FIG. 2, docking assembly engagement member 106 can be cylindrically shaped, but it should be understood that docking assembly engagement member 106 (and complementary members of docking assembly 200) may have any suitable cross-sectional shape.

A latching rib 108 may be provided between the closed end of docking assembly engagement member 106 and hose coupling 110. Latching rib 108 can extend radially outward from adapter 100 to provide a protruding feature that can be grabbed and retained by one or more components of docking assembly 200 during an automatic docking process. A latching O-ring 112 may be positioned in a radial depression proximate to latching rib 108 between the latching rib and the closed end of docking assembly engagement member 106 to enhance the coupling between adapter 100 and the grabbing and retaining components of docking assembly 200.

An automatic docking process can be initiated by moving adapter 100 from an extended position, toward docking assembly 200, and into an engagement region thereof. Docking assembly 200 can include shell 202, gripper 204, compression spring 206, turret 208, captive ring 210, latching jaws 212, and compression ring 214.

Shell 202 may be an open ended, hollow member configured to house the various other components of docking assembly 200 and may be, according to various embodiments, either integrally formed with the faucet body (e.g., faucet body 14 of FIG. 1) or provided as a module (as depicted in FIG. 2) that can be fixedly or removably coupled to the faucet body. The interior dimensions of shell 202 may be complementary to and slightly larger than the exterior dimensions of docking assembly engagement member 106 such that shell 202 can receive docking assembly engagement member 106 via a first open end with little or no play. A second open end of shell 202 may be sized to receive and slidably guide gripper 204. In embodiments in which shell 202 is separate from and coupled to the faucet body, shell 202 can include stepped portion 202*a* formed at the second end. Stepped portion 202*a* may be received inside an open end of the faucet body and coupled thereto using a press fit, threaded coupling, adhesive, or the like.

Gripper 204, housed at least partially within shell 202, can define an internal conduit running longitudinally along its length through which the hose and at least a portion of the adapter may run freely as the spray head is moved between its docked position and its extended position. At a first end, disposed proximate to the first end of shell 202, gripper 204 can include flanged fingers 204*a* extending from gripper body 204*b* that can be configured to grip adapter 100 about latching rib 108 and latching O-ring 112 when under a radially inward directed load. Accordingly, the flanges of flanged fingers 204*a* can extend at least partially in a radially inward direction to retain latching rib 108 within gripper 204. Under no load, flanged fingers 204*a* may extend radially beyond the outer dimensions of gripper body 204*b* such that the cross-sectional area of flanged fingers 204*a* can exceed that of gripper body 204*b* and latching rib 108, thereby allowing flanged fingers 204*a* to disengage adapter 100 from docking assembly 200.

Gripper ring 204*c* may protrude radially outward from gripper body 204*b*, at a position along gripper body 204*b* between flanged fingers 204*a* and a second end of gripper 204. Gripper ring 204*c* may be provided to trap compression spring 206, which can provide a motive force for automatically docking adapter 100 to docking assembly 200. In particular, compression spring 206 may be trapped between gripper ring 204*c* and turret 208, which may be disposed in a space between an interior wall of shell 202 and an exterior wall of gripper 204. Gripper ring 204*c* may include a chamfered edge extending from the wall trapping compression spring 206 to a second surface of gripper ring 204*c* (e.g., a top surface arranged substantially perpendicularly to the wall or to a second wall arranged substantially parallel to the wall such that the chamfered edge forms the entirety of the top surface).

A first end of turret 208, disposed proximate to the first end of shell 202 and the first end of gripper 204, may be provided with a chamfered interior wall 208*a* (see, e.g., FIG. 3). Chamfered interior wall 208*a* may provide varying degrees of internally radially directed load upon flanged fingers 204*a* of gripper 204 as adapter 100 is moved with respect to docking assembly 200. In particular, as adapter 100 moves toward docking assembly 200, gripper 204 can slide against chamfered interior wall 208*a*, which can provide an increasingly large radially inwardly directed force against flanged fingers 204*a*, causing the fingers to close about latching rib 108, thereby retaining adapter 100 within docking assembly 200. Similarly, as adapter 100 moves away from docking assembly 200 (e.g., by a user of the faucet pulling the spray head away from the faucet body), gripper 204 can slide against chamfered interior wall 208*a*, which can decrease the radially inwardly directed force against flanged fingers 204*a*, causing the fingers to spring back to their unloaded positions, to release latching rib 108 and detach adapter 100 from docking assembly 200.

Turret 208 may further be provided with a number of first protrusions 208*b* and a number of second protrusions 208*c* extending radially outward from its main body. First protrusions 208*b* and second protrusions 208*c* may be separated by circumferential depression 208*d*, which can retain captive ring 210 therebetween. Each protrusion of protrusions 208*b* and 208*c* may be separated from its neighboring protrusions by a space. The spaces between first protrusions 208*b* may correspond to the spaces between second protrusions 208*c*.

A number of levers, depicted in FIG. 2 as latching jaws 212, may be engaged in the spaces between first protrusions 208*b* and second protrusions 208*c* such that each latching jaw lies between two of first protrusions 208*b* and two of second protrusions 208*c*. Latching jaws 212 can each include: adapter engagement member 212*a* formed at a first end arranged proximate the first end of shell 202, gripper 204, and turret 208; latching member 212*b* formed at a second end arranged proximate the second end of shell 202, gripper 204, and turret 208; and pivot 212*c* centrally disposed between adapter engagement member 212*a* and latching member 212*b*.

Pivots 212*c* may engage in circumferential depression 208*d* to act as fulcrums for latching jaws 212, which when acted upon by a radially directed force, rotate about pivots 212*c*. Accordingly, pivots 212*c* may elevate the arms of latching jaws 212 above the outer surface of turret 208.

Adapter engagement members 212*a* may be rounded or chamfered for interacting with docking assembly engagement member 106 of adapter 100. When adapter 100 moves towards docking assembly 200, the leading edge of docking assembly engagement member 106 can enter the space between adapter engagement members 212*a* and shell 202 that is open by virtue of the rounded or chamfered shape of the adapter engagement members. As adapter 100 continues to move into engagement with docking assembly 200, the rounded or chamfered shape of adapter engagement members 212*a* can force the first end of latching jaws 212 radially inward, thereby causing latching jaws 212 to rotate about pivots 212*c* and forcing latching members 212*b* in a radially outward direction.

Adapter engagement members 212*a* may be provided with bores 212*aa* for receiving compression ring 214. Compression ring 214 may be routed through bores 212*aa* to provide a radially outward directed force on adapter engagement members 212*a*, such that when adapter 100 is disengaged from docking assembly engagement member 106, adapter engagement members 212*a* are forced radially outwardly and latching members 212*b* are forced radially inwardly. The radially outwardly directed force provided by compression ring 214 may be overcome as docking assembly engagement member 106 engages adapter engagement members 212*a*.

Figure 9:
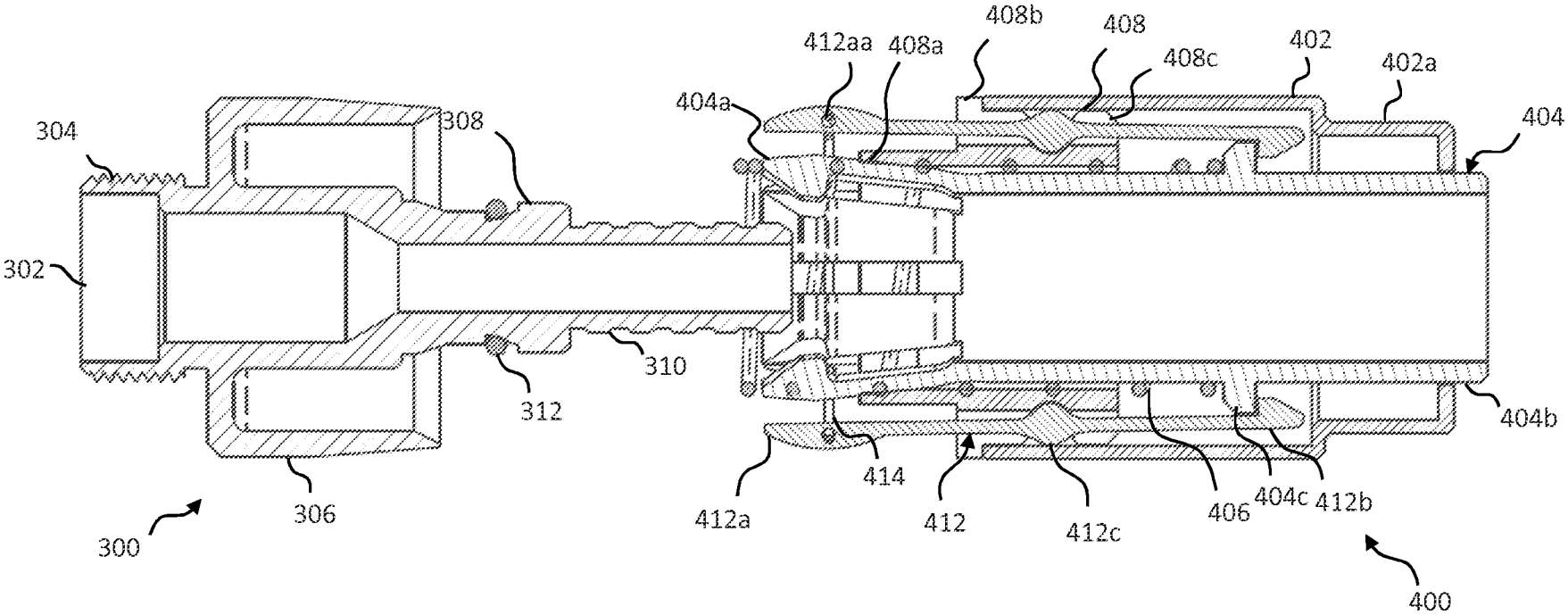
FIG. 9 shows a cross-sectional view of another adapter and docking assembly, in accordance with an embodiment of the present invention.

Turret 208 can be retained within shell 202 using one or more of a press fit, threaded coupling, adhesive, or the like. Additionally, first protrusions 208*b* can include a flange that can interact with a corresponding feature of the shell (e.g., a rib of shell 202 as depicted in FIG. 3 or an edge of shell 402 as depicted in FIG. 9), which can prevent turret 208 from moving in a direction towards the faucet body inside the shell.

Figure 4:
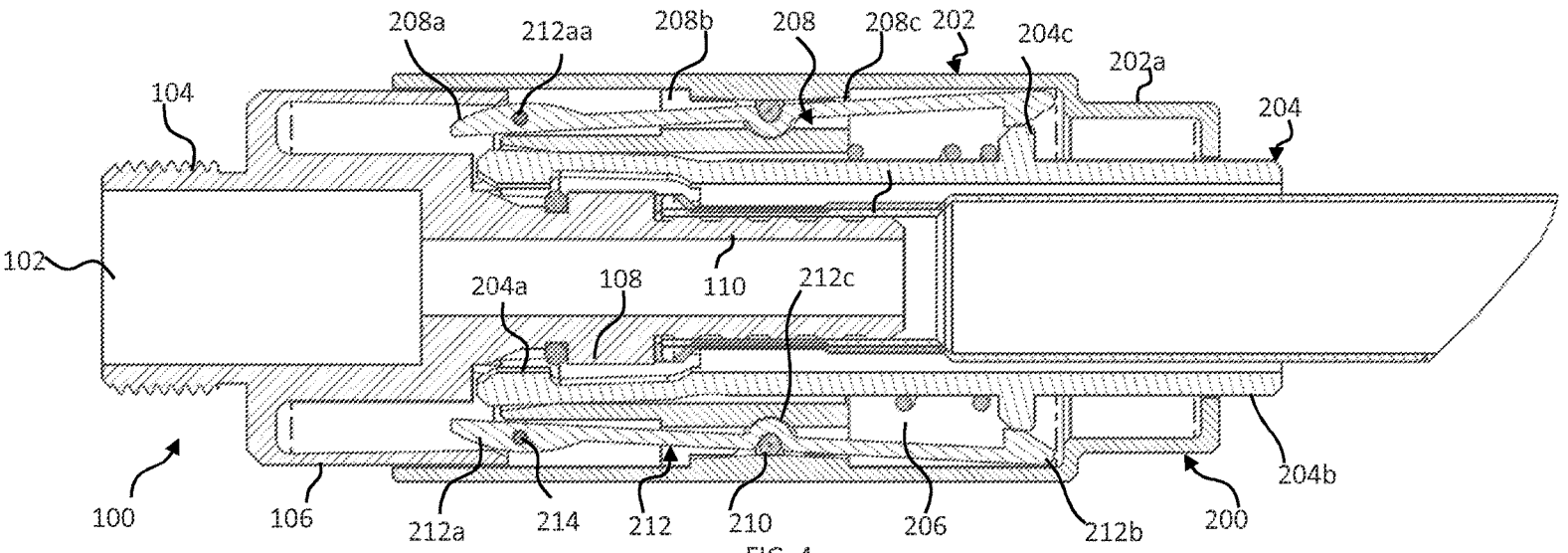
FIGS. 4 and 5 show cross-sectional views of the adapter docking with the docking assembly, in accordance with some embodiments of the present invention.
Figure 5:
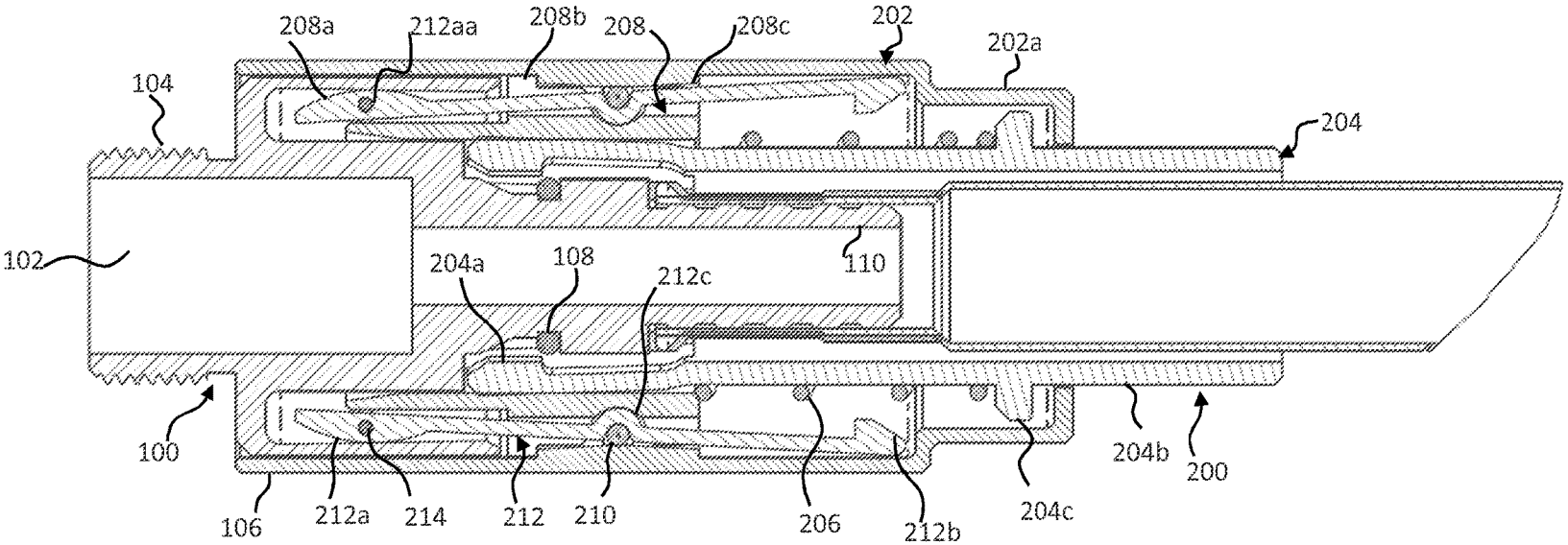

FIGS. 4 and 5 show cross-sectional views of adapter 100 docking with docking assembly 200. In FIG. 4, docking assembly engagement member 106 is depicted interacting with the rounded edge of adapter engagement members 212*a*. In particular, docking assembly engagement member 106 is depicted forcing down upon adapter engagement members 212*a*, thereby causing latching jaw 212 to pivot about pivot 212*c*. This pivoting action allows latching member 212*b* to move radially outward and disengage from gripper ring 204*c*.

Once gripper ring 204*c* is no longer confined by latching member 212*b*, compression spring 206 can expand against the wall of gripper ring 204*c*, thereby forcing gripper 204 to move longitudinally within shell 202 towards the second end of the shell. As gripper 204 moves in relation to shell 202, flanged fingers 204*a* slide along chamfered interior wall 208*a*, which force flanged fingers 204*a* in a radially inward direction to grip latching rib 108 of adapter 100. With adapter 100 retained securely in gripper 204 and latching member 212*b* no longer retaining gripper ring 204*c*, the expansion of compression spring 206 causes adapter 100 to move into the fully docked position depicted in FIG. 5.

In the fully docked position, adapter engagement members 212*a* can reside within the hollow of docking assembly engagement member 106. Compression spring 206 may continue to expand until one or more of the following occurs, defining the docked position: gripper ring 204*c* reaches the second end of shell 202, which acts as a stop to prevent further movement of gripper 204 with respect to shell 202; compression spring 206 reaches its equilibrium position; or docking assembly engagement member 106 reaches first protrusions 208*b* of turret 208.

Figure 6:
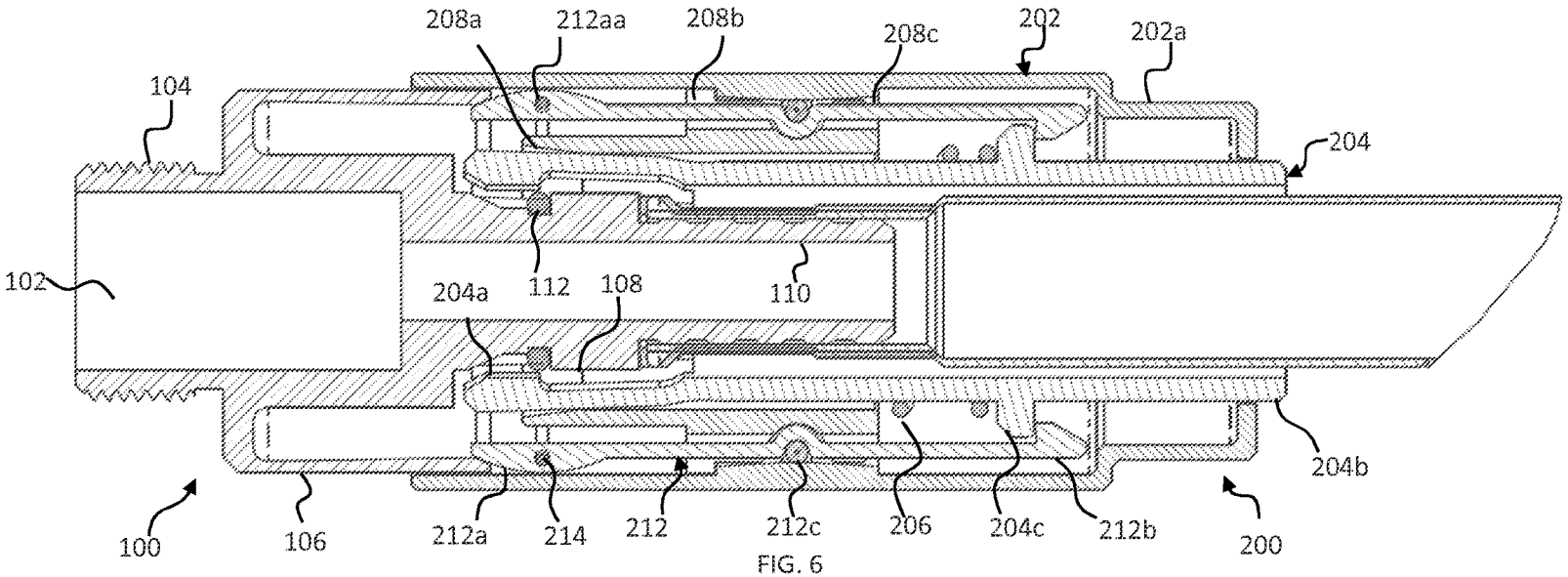
FIGS. 6 and 7 show cross-sectional views of the adapter disengaging from the docking assembly, in accordance with some embodiments of the present invention.
Figure 7:
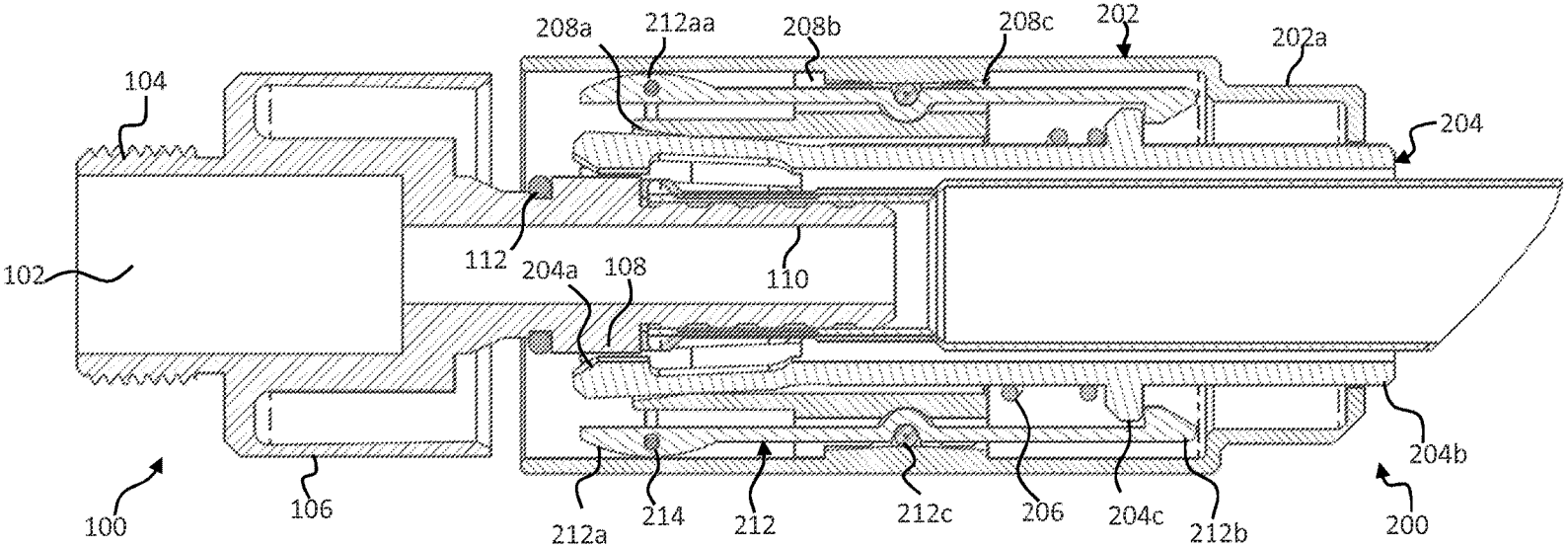

FIGS. 6 and 7 show cross-sectional views of adapter 100 disengaging from docking mechanism 200. As depicted in FIG. 6, as adapter 100 is pulled away from docking mechanism 200, docking assembly engagement member 106 decreases its radially inward force upon adapter engagement members 212*a*, thereby enabling compression ring 214 to force adapter engagement members 212*a* in a radially outward direction. As the adapter engagement members begin to move, latching jaw 212 can pivot about pivot 212*c*, which can force latching member 212*b* in a radially inward direction.

As adapter 100 continues to be pulled away from docking assembly 200, the chamfered edge of latching member 212*b* can slide against the chamfered edge of gripper ring 204*c*. Once gripper ring 204*c* is past latching member 212*b*, latching member 212*b* can latch onto the gripper ring, trapping it and compression spring 206 between latching member 212*b* and turret 208. When in the latched position, docking assembly 200 may be once again ready for the docking procedure illustrated in FIGS. 4 and 5.

Furthermore, as adapter 100 is pulled away from docking assembly 200, flanged fingers 204*a* can slide against chamfered interior wall 208*a*, which permits flanged fingers 204*a* to return to their unloaded state wherein the flanges can be separated too widely to continue to grip latching rib 108. Once flanged fingers 204*a* disengage from latching rib 108, adapter 100 may be pulled freely away from docking assembly 200 as depicted in FIG. 7. Hose 16 may then be extended to facilitate flexible cleaning of items placed under the faucet.

Figure 8:
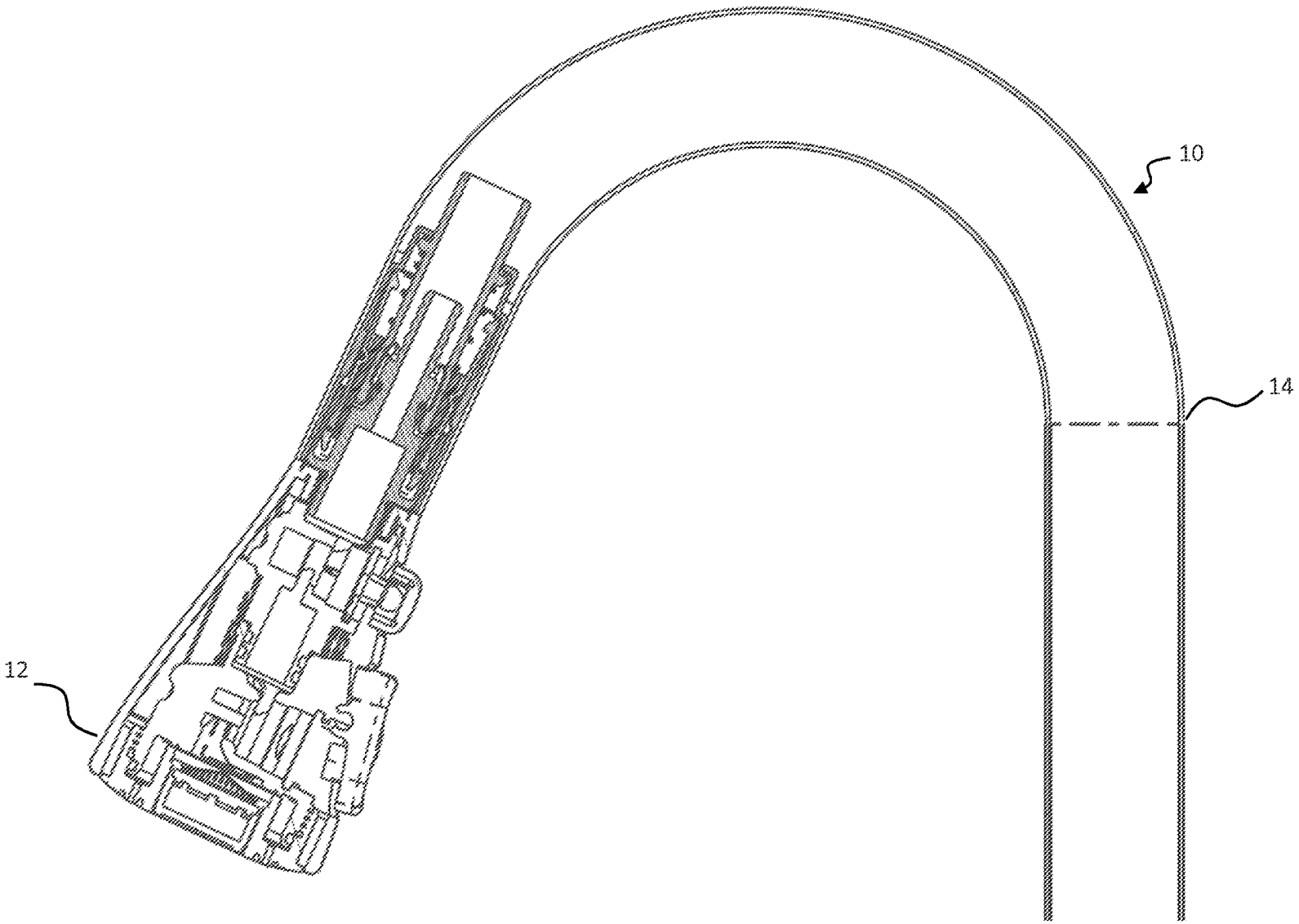
FIG. 8 shows a partial cross-sectional view of a faucet with a spray head and adapter docked with a docking assembly, in accordance with an embodiment of the present invention, in accordance with some embodiments of the present invention.

FIG. 8 shows a partial cross-sectional view of faucet 10 with auto-retracting spray head 12 and adapter 100 docked with docking assembly 200, in accordance with embodiments of the present invention.

FIG. 9 shows a cross-sectional view of adapter 300 and docking assembly 400, in accordance with an embodiment of the present invention. Adapter 300 and docking assembly 400 may be similar to adapter 100 and docking assembly 200 of FIGS. 2-8 with certain notable differences. In the interest of brevity, only the differences will be discussed below; reference numbers 1xx and 2xx of adapter 100 and docking assembly 200 have been replaced with reference numbers 3xx and 4xx for adapter 300 and docking assembly 400.

Docking assembly 400 includes shell 402 that extends only as far as first protrusions 408*b* of turret 408. The shorter shell, compared with shell 202, for example, may permit adapter engagement member 412*a* of latching jaw 412 to open wider than would be possible if constrained by a shell. With adapter engagement member 412*a* opening wider, latching member 412*b* can latch onto gripper ring 404*c* more strongly.

Furthermore, pivot 412*c* of docking assembly 400 can protrude outward on either side of latching jaw 412 to form the jaw's pivot point. In this manner, a separate captive ring, such as captive ring 210, for example, may not be required to allow latching jaw 412 to pivot.

Still further, latching O-ring 312 of adapter 300 may be seated in a depression that separates the O-ring from latching rib 308 by a gap. The gap between O-ring 312 and latching rib 308 may permit flanged fingers 404*a* of gripper 404 to contact latching rib 308 directly and with a larger surface area, thus potentially improving the grip of gripper 404 on adapter 300.

It should be understood that the aspects, features and advantages made apparent from the foregoing are efficiently attained and, since certain changes may be made in the disclosed inventive embodiments without departing from the spirit and scope of the invention, it is intended that all matter contained herein shall be interpreted as illustrative and not in a limiting sense.

It is also to be understood that the following claims are intended to cover all of the generic and specific features of the invention herein described, and all statements of the scope of the invention that, as a matter of language, might be said to fall there between.

What is claimed is:

1. A docking assembly attachable to a faucet body, the docking assembly comprising:

a shell;

a gripping member slidably housed at least partially within the shell, the gripping member comprising a gripper body and a gripper ring extending from the gripper body;

a turret fixed within the shell and concentrically arranged about at least a portion of the gripping member, the turret comprising a first end having a chamfered interior wall; and a captive spring arranged between the gripper ring and a second end of the turret, opposite the first end, the captive spring configured to provide a motive force to move the gripping member from an extended position to a docked position, wherein the extended position corresponds to the captive spring in a compressed position, and the motive force comprises expanding the captive spring from the compressed position to an expanded position.

2. The docking assembly of claim 1, further comprising:

a plurality of latching jaws pivotably arranged between the turret and the shell.

3. The docking assembly of claim 2, wherein each latching jaw of the plurality of latching jaws comprises:

a latching member formed at the second end, the latching member configured to latch onto the gripper ring when the docking assembly is in the extended position.

4. The docking assembly of claim 3, wherein each latching jaw of the plurality of latching jaws is pivotable to de-latch from the gripper ring when the docking assembly is moved from the extended position to the docked position.

5. The docking assembly of claim 4, wherein each latching jaw of the plurality of latching jaws further comprises:

an adapter engagement member comprising one of a rounded and a chamfered edge for receiving an adapter between the adapter engagement member and the shell, such that interaction between the adapter and the adapter engagement member pivots the plurality of latching jaws.

6. The docking assembly of claim 5, further comprising:

a compression ring retained within bores formed in the adapter engagement member of each latching jaw of the plurality of latching jaws, wherein the compression ring is configured to provide a radially outward directed force upon each adapter engagement member.

7. The docking assembly of claim 2, wherein the turret further comprises a circumferential depression.

8. The docking assembly of claim 7, wherein each latching jaw of the plurality of latching jaws further comprises:

a pivot arranged at least partially in the circumferential depression, wherein the pivot provides a pivot point for the latching jaw.

9. The docking assembly of claim 8, further comprising:

a captive ring arranged concentrically between the pivot and the shell.

10. The docking assembly of claim 7, further comprising:

a first plurality of protrusions separated by a first plurality of spaces;

a second plurality of protrusions separated by a second plurality of spaces, wherein the circumferential depression is arranged between the first plurality of protrusions and the second plurality of protrusions, and wherein each latching jaw of the plurality of latching jaws is disposed in a space of the first plurality of spaces and a space of the second plurality of spaces.

11. The docking assembly of claim 1, wherein the gripping member comprises:

a plurality of flanged fingers extending from the gripper body, each flanged finger of the plurality of flanged fingers comprising a flange directed at least partially radially inward, wherein the plurality of flanged fingers extend at least partially beyond an outer dimension of the gripper body under no external load.

12. The docking assembly of claim 11, wherein the plurality of flanged fingers slide along the chamfered interior wall as the docking assembly is moved from the extended position to the docked position, the chamfered interior wall providing an increasing load upon the plurality of flanged fingers as the gripping member is moved towards the docked position.

13. The docking assembly of claim 1, wherein the shell comprises:

a stepped portion configured to be retained within the faucet body; and an apertured end arranged at an end of the stepped portion for slidably receiving the gripper body, wherein the apertured end forms a stop for the gripper ring.

14. An auto-retracting mechanism for a faucet spray head, comprising:

the docking assembly of claim 1; and an adapter configured to couple to the faucet spray head.

15. The auto-retracting mechanism of claim 14, wherein the adapter comprises:

a body defining an internal conduit;

a docking assembly engagement member extending from and concentrically arranged about at least a portion of the body; and a latching rib extending radially away from the body.

16. The auto-retracting mechanism of claim 15, wherein the docking assembly engagement member is slidably receivable in the shell.

17. The auto-retracting mechanism of claim 15, wherein the body comprises a hose coupling slidably receivable in the gripping member.

18. The auto-retracting mechanism of claim 15, wherein the gripping member grips the latching rib as the auto-retracting mechanism is moved from the extended position to the docked position to pull the adapter into engagement with the docking assembly.

19. The auto-retracting mechanism of claim 18, further comprising: a latching O-ring arranged in a circumferential depression adjacent to the latching rib.

20. The auto-retracting mechanism of claim 18, wherein the body further comprises:

a spray head coupling member detachably coupleable to the faucet spray head.

21. A faucet comprising:

a faucet body;

a hose connectable to a water source disposed in and moveable through the faucet body; and the auto-retracting mechanism of claim 14, wherein the hose is fluidly coupled to the adapter.

22. The docking assembly of claim 1, wherein the captive spring is disposed within a space defined by the gripper ring, the second end of the turret, an interior wall of the shell, and an exterior wall of the gripping member.

23. The docking assembly of claim 1, wherein expansion of the captive spring causes a spray head to move to the docked position.

* * * * *